US008814761B2

(12) United States Patent
Rich et al.

(10) Patent No.: US 8,814,761 B2
(45) Date of Patent: Aug. 26, 2014

(54) BODYWEIGHT RESISTED EXERCISE APPARATUS AND METHOD

(76) Inventors: Douglas J. Rich, Mesa, AZ (US); Aaron K. Radelow, Escondido, CA (US)

( * ) Notice: Subject to any disclaimer, the term of this patent is extended or adjusted under 35 U.S.C. 154(b) by 471 days.

(21) Appl. No.: 12/729,964

(22) Filed: Mar. 23, 2010

(65) Prior Publication Data

US 2011/0237408 A1 Sep. 29, 2011

(51) Int. Cl.
*A63B 21/00* (2006.01)
*A63B 21/068* (2006.01)
*A63B 26/00* (2006.01)

(52) U.S. Cl.
USPC ..... 482/95; 482/96; 482/131; 482/143

(58) Field of Classification Search
USPC ..... 482/23, 24, 33, 43, 69, 103, 91–96, 482/121–123, 129–131, 141–143
See application file for complete search history.

(56) References Cited

U.S. PATENT DOCUMENTS 1,104,505 A * 7/1914 Holworthy ..... 482/24
2,262,761 A * 11/1941 Gay ..... 482/24
4,973,050 A * 11/1990 Santoro et al. ..... 482/102
5,298,004 A * 3/1994 Davis ..... 482/99
5,944,640 A * 8/1999 Larsson ..... 482/96
6,267,711 B1 * 7/2001 Hinds ..... 482/121
6,319,179 B1 * 11/2001 Hinds ..... 482/121
6,443,877 B1 * 9/2002 Hoecht et al. ..... 482/103
7,455,634 B2 * 11/2008 Barniak ..... 482/143
7,775,949 B2 * 8/2010 Bowser ..... 482/121
8,057,371 B2 * 11/2011 McBride et al. ..... 482/142
2005/0130814 A1 * 6/2005 Nitta et al. ..... 482/121
2011/0028281 A1 * 2/2011 Ish et al. ..... 482/95

FOREIGN PATENT DOCUMENTS

FR 2690628 A1 * 11/1993

* cited by examiner

*Primary Examiner* — Oren Ginsberg
(74) *Attorney, Agent, or Firm* — Weiss & Moy, P.C.; Veronica-Adele R. Cao

(57) ABSTRACT

A bodyweight resistance exercise apparatus has a base portion, a platform secured to the base portion, main vertical supports coupled to an end of the base portion, upper vertical supports coupled to an upper end of the main vertical supports and angled relative thereto, and lifting straps coupled through the upper vertical supports and to the main vertical supports. Adjustability may be provided in a number of ways, including with respect to the location of the platform along the base portion, the angle of the main vertical supports relative to the base portion, the rotational position of the upper vertical supports relative to the main vertical supports, and the attachment of the lifting straps along the main vertical supports. When a desired configuration is achieved, a user may perform bodyweight resistance exercise in a core-stabilized position.

14 Claims, 5 Drawing Sheets

FIG. 2A
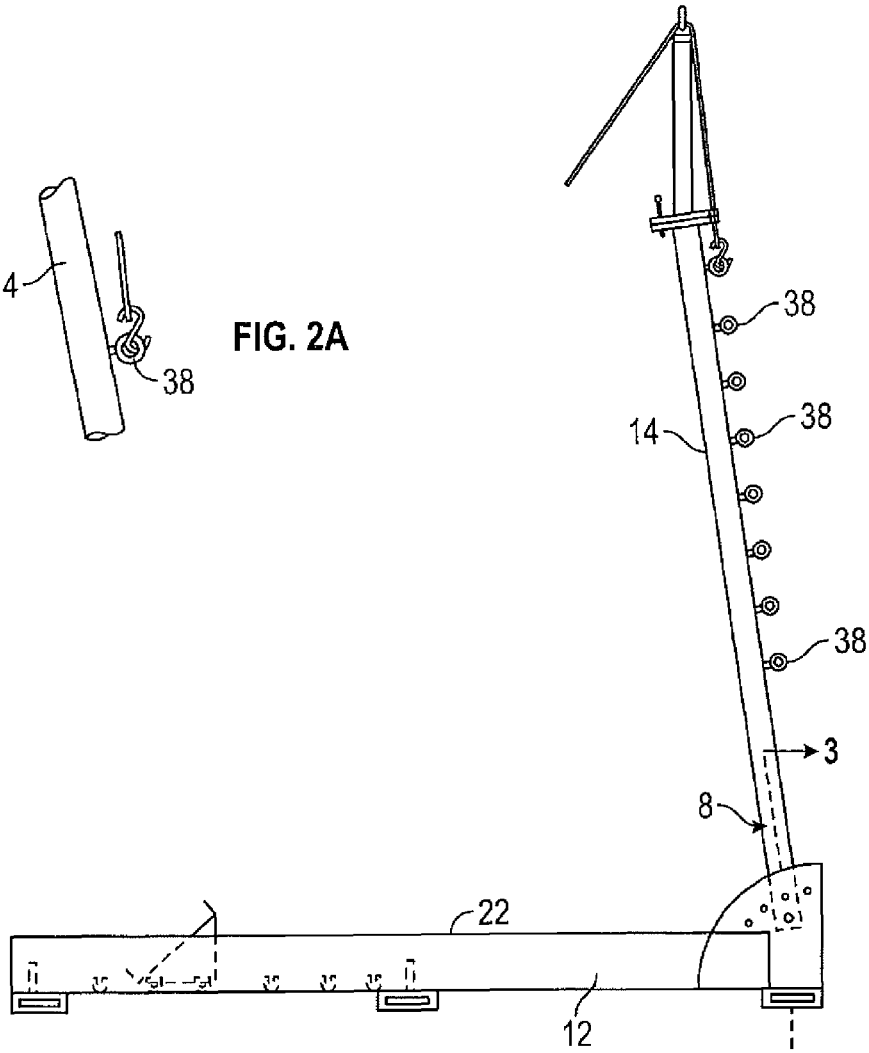
FIG. 2
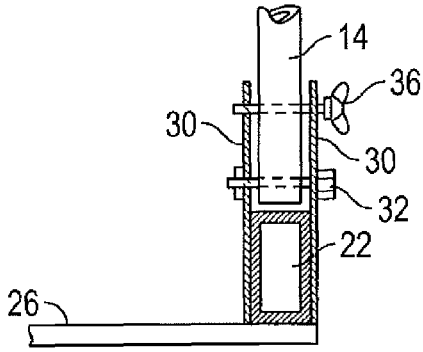
FIG. 3

BODYWEIGHT RESISTED EXERCISE APPARATUS AND METHOD

FIELD OF THE INVENTION

The present invention relates generally to exercise apparatuses and methods and, more particularly, a bodyweight exercise apparatus and method that allows extremity strengthening in a core-stabilized position.

BACKGROUND OF THE INVENTION

Gymnastics routines, such as those involving rings, can provide significant exercise benefits by strengthening a participant's arms, shoulders and chest. However, they are extremely difficult to perform and, as a practical matter, ring routines are not accessible to person's who have not devoted years of training to gymnastics.

The TRX® Suspension Trainer™ is a device that provides some simulation of a gymnastics ring exercise for a person who may never have engaged in formal gymnastics training. It comprises two straps that are secured to a rack or other secure object and two handles or rings that are positioned on the ends of the straps and that may be grasped by a user. Using the TRX® Suspension Trainer™, a user may perform such exercises as an inverted row, push up, and lunge.

There are several limitations with this prior art device. It does not provide for a core stabilized position during exercise, which can limit intensity and create a risk of injury. It also does not permit adjustment of the angle of exercise, once the straps are secured to a rack or other secured object, substantially limiting exercise benefit from the device. Still further, the prior art device does not permit the user to reproduce the exercise each time in a consistent manner, since foot position can vary widely from use to use. The lack of a controlled ground surface can also limit the safety of the prior art device.

The apparatus and method of the present invention addresses these limitations and provides other, related, advantages.

SUMMARY OF THE INVENTION

In accordance with an embodiment of the present invention, a bodyweight resistance exercise apparatus is disclosed. The apparatus comprises, in combination: a base portion having a first end and a second end; main vertical supports having an upper end and a lower end; wherein the lower ends of the main vertical supports are coupled to the first end of the base portion; a platform having an angled foot receiving surface thereon; wherein the platform is secured along a length of the base portion; upper vertical supports having an upper end and a lower end; wherein the lower ends of the upper vertical supports are coupled to the upper ends of the main vertical supports so that the upper vertical supports extend at an angle relative to the main vertical supports; first and second exercise straps, each having an attachment end and a handle end; at least one attachment point on each of the main vertical supports, adapted to receive the attachment end of one of the exercise straps; an eyelet positioned at an upper end of the upper vertical support and adapted to receive one of the exercise straps therethrough.

In accordance with another embodiment of the present invention, a bodyweight resistance exercise apparatus is disclosed. The apparatus comprises, in combination: a base portion having a first end and a second end; main vertical supports having an upper end and a lower end; wherein the lower ends of the main vertical supports are coupled to the first end of the base portion; a platform having an angled foot receiving surface thereon; wherein the platform is secured along a length of the base portion; upper vertical supports having an upper end and a lower end; wherein the lower ends of the upper vertical supports are rotatably coupled to the upper ends of the main vertical supports so that the upper vertical supports extend at an angle relative to the main vertical supports; first and second exercise straps, each having an attachment end and a handle end; a plurality of attachment points on each of the main vertical supports, adapted to receive the attachment end of one of the exercise straps; and an eyelet positioned at an upper end of the upper vertical support and adapted to receive one of the exercise straps therethrough.

In accordance with a further embodiment of the present invention, a method for performing a bodyweight resistance exercise is disclosed. The method comprises: providing a bodyweight resistance exercise apparatus comprising, in combination: a base portion having a first end and a second end; main vertical supports having an upper end and a lower end; wherein the lower ends of the main vertical supports are coupled to the first end of the base portion; a platform having an angled foot receiving surface thereon; wherein the platform is secured along a length of the base portion; upper vertical supports having an upper end and a lower end; wherein the lower ends of the upper vertical supports are rotatably coupled to the upper ends of the main vertical supports so that the upper vertical supports extend at an angle relative to the main vertical supports; first and second exercise straps, each having an attachment end and a handle end; a plurality of attachment points on each of the main vertical supports, adapted to receive the attachment end of one of the exercise straps; and an eyelet positioned at an upper end of the upper vertical support and adapted to receive one of the exercise straps therethrough; attaching the ends of the exercise straps to aligned attachment points on the main vertical supports; grasping the handle ends; and performing an exercise.

BRIEF DESCRIPTION OF THE DRAWINGS

FIG. 2 is a side view of the apparatus of FIG. 1.

FIG. 2*a* is a perspective view of a portion of the apparatus of FIG. 1, illustrating coupling between a strap end and the apparatus.

FIG. 3 is an end, cross-sectional view of a portion of the apparatus of FIG. 1, illustrating an adjustment mechanism for a portion of the apparatus.

DETAILED DESCRIPTION OF THE PREFERRED EMBODIMENTS

Figure 1:
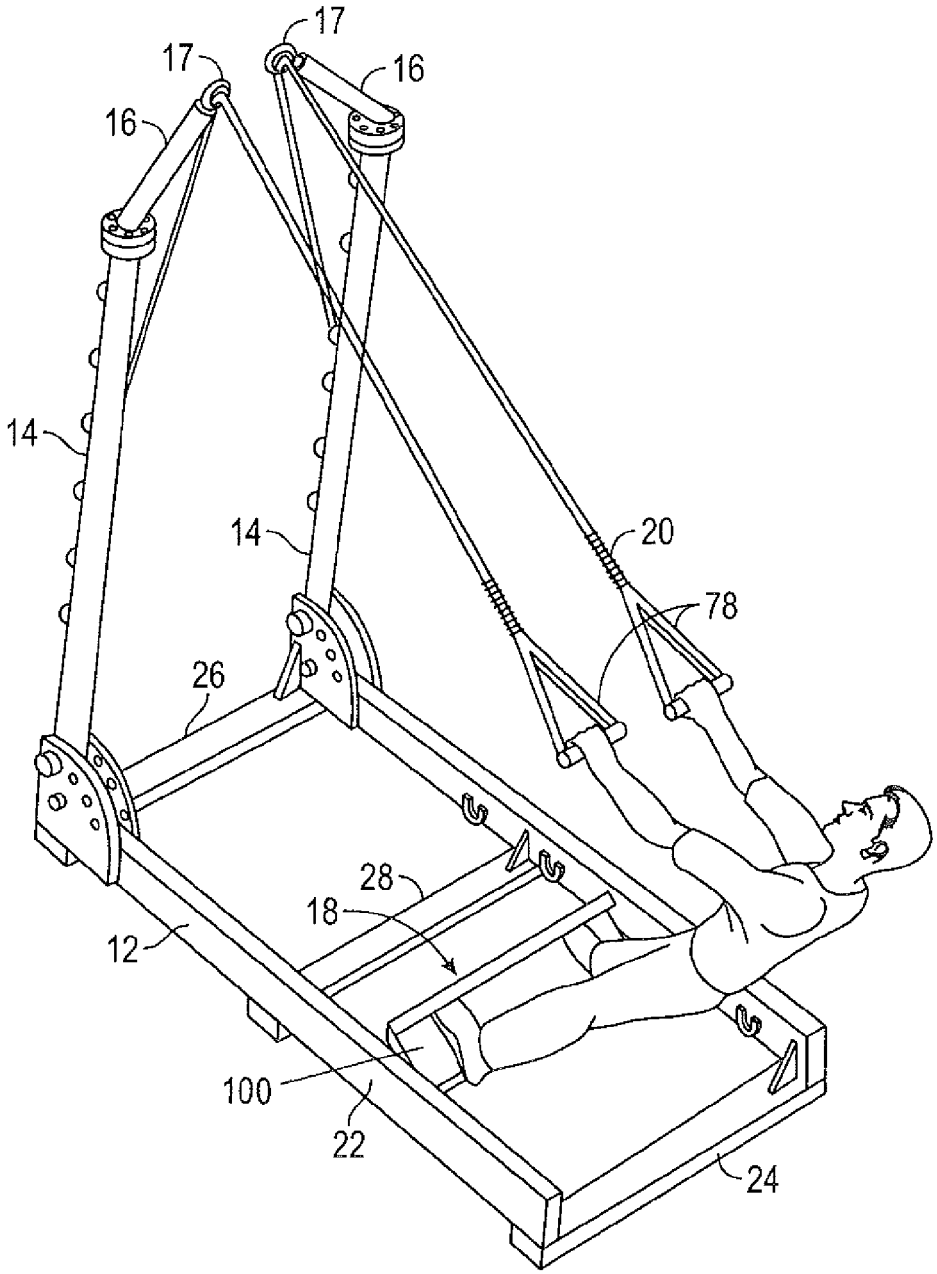
FIG. 1 is a perspective view of a bodyweight resistance exercise apparatus consistent with an embodiment of the present invention.
Figure 4:
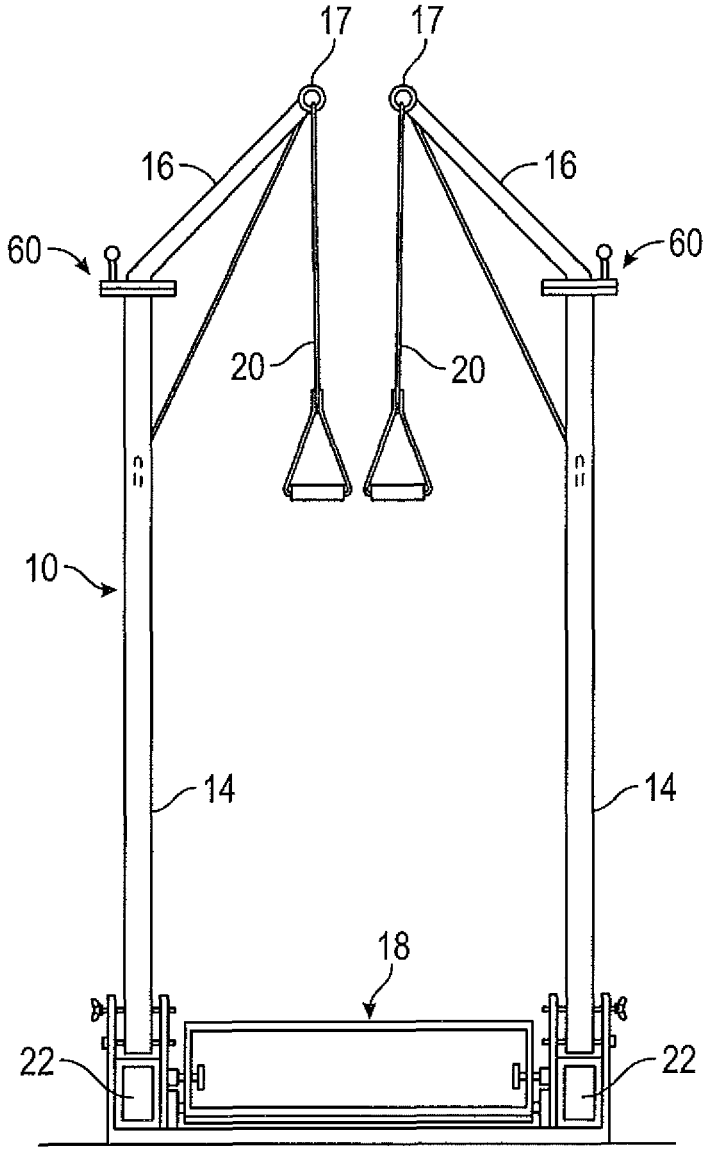
FIG. 4 is a front view of the apparatus of FIG. 1.
Figure 5:
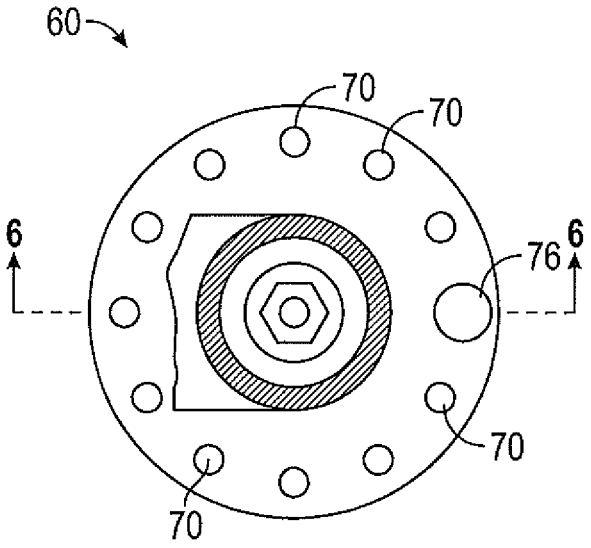
FIG. 5 is a top, partially cross-sectional view of an arm position adjustment portion of the apparatus of FIG. 1.
Figure 6:
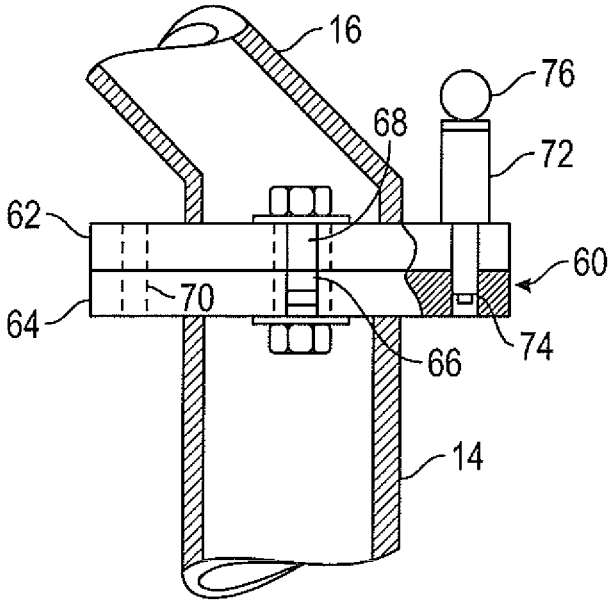
FIG. 6 is a cross-sectional view of the arm position adjustment portion of FIG. 5, taken along line 6-6.
Figure 7:
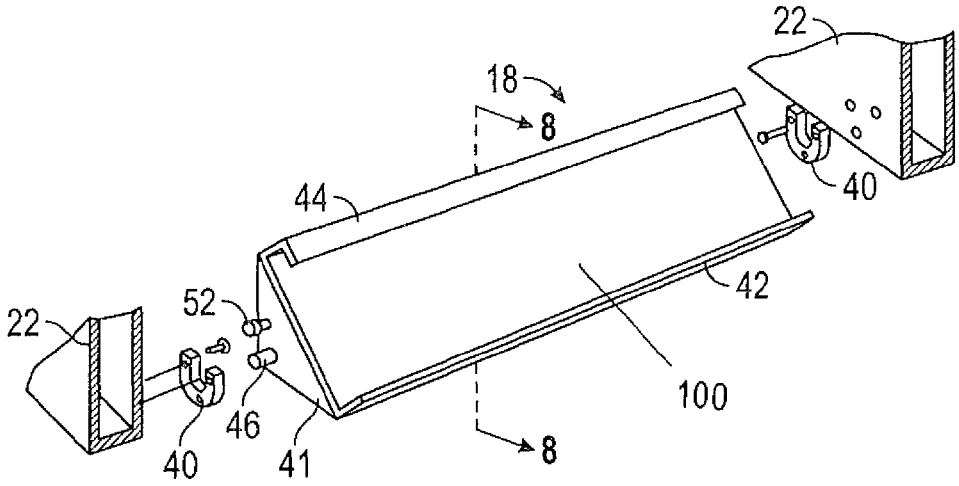
FIG. 7 is an exploded perspective view of an adjustable foot support portion of the apparatus of FIG. 1.

Referring first to FIGS. 1 and 4, the main components of a bodyweight resistant apparatus 10 ("apparatus 10") consistent with an embodiment of the present invention are shown.

These include a base portion 12, a pair of main vertical supports 14 coupled to an end of the base portion 12, upper vertical supports 16 coupled to an upper portion of the main vertical supports 14, a platform 18 coupled to the base portion 12, and a pair of lifting straps 20 coupled to the main vertical supports 16 and passing through end portions of the upper vertical supports 16. Construction of the apparatus 10 and its use will now be described in greater detail.

The base portion 12, best seen in FIG. 1, may be formed as a four-sided frame structure, comprising long sides 22, first short side 24, second short side 26, and at least one support brace 28.

As best seen in FIGS. 1-4, the main vertical supports 14 are each preferably coupled at a lower end thereof to an end of the base portion 12, proximate the second short side 26. More specifically, such coupling preferably allows adjustment of an angle between the main vertical supports 14 and the base portion 12. In one embodiment, this is accomplished by providing at each base of the main vertical supports a pair of plates 30 that are fixedly coupled to an end of the long sides 22 and the second short side 26. Each pair of plates 30 provides sufficient space therebetween so as to receive an end of a main vertical support 14.

The end of the main vertical support 14 is rotatably retained between the pair of plates 30 by a hinge pin 32 or the like, extending through aligned openings (not shown) in the plates 30 and main vertical support 14. A plurality of aligned openings 34 are provided along the pair of plates 30, and fixed coupling of the main vertical support 14 to the pair of plates 30 may be provided by insertion of a removable bolt 36 through a pair of aligned openings 34 and opening (not shown) in the main vertical support 14. It can thus be seen that removal of the bolt 36 allows rotation of the main vertical support about hinge pin 32 until a desired angle is achieved, at which time the bolt 36 may be inserted through the aligned openings 34 and opening (not shown) in the main vertical support 14 located at that desired angle.

As best seen in FIGS. 1, 2 and 2*a*, it is desired to provide a plurality of attachment points 38, to which an end of a lifting strap 20 may be removably coupled. In one embodiment, the attachment points 38 may be in the shape of an eye-bolt. The plurality of attachment points 38 may be spaced at even intervals and permit a user, as discussed below, to make desired adjustments in the angle of exercise.

Also located on the base portion 12 are a plurality of cradles 40 for receiving the platform 18. The platform 18, best seen in FIGS. 1, 4, 7 and 8, may have a substantially triangular cross-section created by three-sided side panels 41, and includes a foot receiving surface 100 that is coupled to the long side of side panels 41 and presented at a substantially 45-degree angle toward the first short side 24. (A rear of the platform 18 is preferably left open, so that a user may have access thereto for purposes of alternately removing and securing the platform 18 on the base portion 12, as described below.) The platform 18 may further include a heel stop 42 projecting outward from a larger margin of the foot receiving surface 100 and along a length thereof, and an L-shaped toe capture 44 projecting outward from an upper margin of the foot receiving surface 100 and along a length thereof. It may be desired to further provide on or proximate platform 18 a back pad and/or hand graps (not shown) as a way of providing still further stability during exercise and a greater ability to reproduce a particular exercise with precision.

As shown in FIG. 1, during use, a person places his or her feet on the foot receiving surface 100, so that the heels contact the heel stop 42 and the toes are positioned beneath the toe capture 44. The heel stop 42 and toe capture 44 serve to more securely and stably retain a user's feet in position during exercise.

Figure 8:
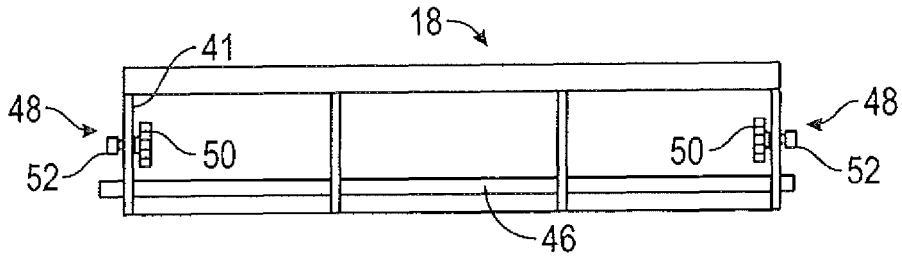
FIG. 8 is a front, cross-sectional view of the foot support portion shown in FIG. 7.
Figure 8A:
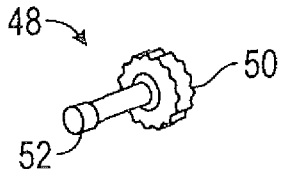
FIG. 8*a* is a perspective view of a component of the adjustable foot support portion shown in FIGS. 7 and 8.

As seen in FIG. 8, the tilting platform 18, in one embodiment, has a rod 46 positioned along a length thereof, and projecting outward through side panels 41. Also projecting outward through side panels 41 and threadably engaged therewith are friction knobs 48, the handles 50 of which may be accessed through the exposed rear of the platform 18. See FIG. 8. As shown in FIG. 1, there are preferably a plurality of opposing cradles 40, located along an interior length of long sides 22 of the base portion 12. The exposed ends of the rod 46 are adapted to be inserted into aligned cradles 40, at a desired location along the base portion 12. When the desired cradles 40 have been selected and the platform 18 positioned thereon with rod 46, the handles 50 may be turned so as to cause a friction end 52 of the friction knobs 48 to come into contact with the base portion 12, so as to prevent undesired movement of the platform 18 during exercise. To remove the platform 18, the handles 50 are turned in the opposing direction until there is no longer contact between the friction end 52 and the base portion 12, at which time the platform 18 may be lifted until the rod 46 is no longer engaged with opposing cradles 40.

Turning now to the upper vertical supports 16, these may be rotatably coupled at an upper end of the main vertical supports 14, so as to project at an angle therefrom. Adjustable rotation of the upper vertical supports 16 relative the main vertical supports 14 may be provided by a swivel plate assembly 60 consisting of an upper swivel plate 62 coupled to a lower end of each upper vertical support 16, a lower swivel plate 64 coupled to an upper end of each main vertical support, a bolt 66 retained through aligned central openings 68 in the upper and lower swivel plates 62 and 64 in a manner that permits the plates 62 and 64 to rotate relative to each other.

A plurality of openings 70 are positioned around a circumference of at least the lower swivel plate 64. A quick release pin 72 is located on the upper swivel plate 62, so that the pin 74 thereof extends through the upper swivel plate 62 and into one of the openings 70. To adjust position of the upper vertical support 16, a handle 76 of the quick release pin 72 is pulled until the pin 74 is withdrawn from the opening 70 in the lower swivel plate 64. The upper vertical support 16 may then be rotated until in the desired position. At that point, the handle 76 is released and the pin 74 enters the opening 70 in the lower swivel plate 64.

Located at an upper end of the upper vertical supports 16 are eyelets 17, through which straps 20 may be positioned, as seen in FIGS. 1-2 and 4. First ends of the straps 20 are removably secured to attachment points 38, at a desired height. Second ends of the straps 20 terminate in handles 78 which are held by a person during exercise, as shown in FIG. 1. It may be desired to also or alternatively provide on straps 20 foot stirrups not shown), to permit a user to anchor his or her feet and to reverse a particular exercise.

Prior to performing bodyweight resistance exercise using the apparatus 10, the user may wish to adjust one or more of the adjustable components thereof. For example, the user may wish to adjust the angle of the main vertical supports 14 relative the base portion 10, the position of the platform 18 along the base portion 10, the second ends of the straps 20 along a length of the main vertical supports 14, and the position of the upper vertical supports 16 relative to the main vertical supports 14.

When the desired positioning of the various components is obtained, the user may commence exercise, as shown by way of example in FIG. 1. The user may exercise his or her upper body or lower body by grasping the rings and performing any one of a number of different exercise movements. During exercise, the platform 18 maintains the user's core in a stabilized position, improving exercise efficiency and safety.

Although particular embodiments of the invention have been described in detail for purposes of illustration, various modifications may be made without departing from the spirit and scope of the invention. Accordingly, the invention is not to be limited, except as by the appended claims.

What is claimed is:

1. A bodyweight resistance exercise apparatus comprising, in combination:

a base portion having a first end and a second end;

main vertical supports having an upper end and a lower end;

wherein the lower ends of the main vertical supports are coupled to the first end of the base portion;

a platform having an angled foot receiving surface thereon;

wherein the platform is secured along a length of the base portion;

upper vertical supports having an upper end and a lower end;

wherein the lower ends of the upper vertical supports are coupled to the upper ends of the main vertical supports so that the upper vertical supports extend at an angle relative to the main vertical supports;

first and second exercise straps, each having an attachment end and a handle end;

at least one attachment point on each of the main vertical supports, adapted to receive the attachment end of one of the exercise straps;

an eyelet positioned at an upper end of the upper vertical support and adapted to receive one of the exercise straps therethrough.

2. The bodyweight resistance exercise apparatus of claim 1 further comprising a plurality of opposing cradles located along an interior length of the base portion and adapted to removably receive therein the platform, so that the platform may be alternately positioned at different points along the length of the base portion.

3. The bodyweight resistance exercise apparatus of claim 1 further comprising an angle adjustment mechanism, permitting adjustment of an angle between the main vertical supports and the base portion.

4. The bodyweight resistance exercise apparatus of claim 3 wherein the angle adjustment mechanism is coupled to the base portion, receives therein the lower end of the main vertical support, and permits the main vertical support to be selectively retained at one of a plurality of points along the angle adjustment mechanism.

5. The bodyweight resistance exercise apparatus of claim 1, wherein the platform has a heel stop projecting outward from a larger margin of the foot receiving surface and along a length thereof and an L-shaped toe capture projecting outward from an upper margin of the foot receiving surface and along a length thereof.

6. The bodyweight resistance exercise apparatus of claim 1, further comprising a swivel assembly, permitting swiveling of the upper vertical support relative to the main vertical support,

7. The bodyweight resistance exercise apparatus of claim 6, wherein the swivel assembly comprises an upper swivel plate coupled to the lower end of the upper vertical support, a lower swivel plate coupled to the upper end of the main vertical support, a bolt retained through aligned central openings in the upper and lower swivel plates in a manner that permits the plates to rotate relative to each other, a plurality of openings positioned around a circumference of at least the lower swivel plate, and a quick release pin located on the upper swivel plate and configured so as to extend through the upper swivel plate and into one of the openings, so as to permit the upper vertical support to be rotated until a desired orientation is achieved, and to then be secured in position by inserting the quick release pin into the desired opening in the lower swivel plate.

8. The bodyweight resistance exercise apparatus of claim 1, further comprising a plurality of attachment points on each of the main vertical supports, adapted to receive the attachment end of one of the exercise straps.

9. A bodyweight resistance exercise apparatus comprising, in combination:

a base portion having a first end and a second end;

main vertical supports having an upper end and a lower end;

wherein the lower ends of the main vertical supports are coupled to the first end of the base portion;

a platform having an angled foot receiving surface thereon;

wherein the platform is secured along a length of the base portion;

upper vertical supports having an upper end and a lower end;

wherein the lower ends of the upper vertical supports are rotatably coupled to the upper ends of the main vertical supports so that the upper vertical supports extend at an angle relative to the main vertical supports;

first and second exercise straps, each having an attachment end and a handle end;

a plurality of attachment points on each of the main vertical supports, adapted to receive the attachment end of one of the exercise straps; and an eyelet positioned at an upper end of the upper vertical support and adapted to receive one of the exercise straps therethrough.

10. The bodyweight resistance exercise apparatus of claim 9, further comprising a plurality of opposing cradles located along an interior length of the base portion and adapted to removably receive therein the platform, so that the platform may be alternately positioned at different points along the length of the base portion.

11. The bodyweight resistance exercise apparatus of claim 9 further comprising an angle adjustment mechanism, permitting adjustment of an angle between the main vertical supports and the base portion.

12. The bodyweight resistance exercise apparatus of claim 11 wherein the angle adjustment mechanism is coupled to the base portion, receives therein the lower end of the main vertical support, and permits the main vertical support to be selectively retained at one of a plurality of points along the angle adjustment mechanism.

13. The bodyweight resistance exercise apparatus of claim 9, wherein the platform has a heel stop projecting outward from a larger margin of the foot receiving surface and along a length thereof and an L-shaped toe capture projecting outward from an upper margin of the foot receiving surface and along a length thereof.

14. The bodyweight resistance exercise apparatus of claim 9, wherein rotation of the upper vertical support relative to the main vertical support is enabled by a swivel assembly comprising an upper swivel plate coupled to the lower end of the upper vertical support, a lower swivel plate coupled to the upper end of the main vertical support, a bolt retained through aligned central openings in the upper and lower swivel plates in a manner that permits the plates to rotate relative to each other, a plurality of openings positioned around a circumference of at least the lower swivel plate, and a quick release pin located on the upper swivel plate and configured so as to extend through the upper swivel plate and into one of the openings, so as to permit the upper vertical support to be rotated until a desired orientation is achieved, and to then be secured in position by inserting the quick release pin into the desired opening in the lower swivel plate.

* * * * *